United States Patent [19]

Loikitz

[11] 4,030,161

[45] June 21, 1977

[54] SELF-CLOSING SPRING HINGES

[75] Inventor: Frank F. Loikitz, Middletown, N.J.

[73] Assignee: Buildex Incorporated, Huntington, N.Y.

[22] Filed: Oct. 29, 1976

[21] Appl. No.: 737,138

[52] U.S. Cl. ..... 16/186

[51] Int. Cl.[2] ..... E05F 1/12

[58] Field of Search ..... 16/128 R, 180, 185 R, 16/185 V, 186, 188, 189, 152, 153, 168, 169, 170, 50, 54

[56] References Cited

UNITED STATES PATENTS

| | | | |
|---|---|---|---|
| 3,098,258 | 7/1963 | Ruiz | 16/153 X |
| 3,401,422 | 9/1968 | Ventura | 16/54 |
| 3,748,688 | 7/1973 | Berkowitz | 16/153 |
| 3,955,241 | 5/1976 | Little | 16/180 |

FOREIGN PATENTS OR APPLICATIONS

| | | | |
|---|---|---|---|
| 412,292 | 11/1945 | Italy | 16/186 |

*Primary Examiner*—G. V. Larkin

*Attorney, Agent, or Firm*—Blum, Moscovitz, Friedman & Kaplan

[57] ABSTRACT

A hinge having stationary and turnable components which respectively carry cams which cooperate with each other to displace the turnable component upwardly with respect to the stationary component during opening movement while permitting the turnable component to move downwardly with respect to the stationary component during closing movement. In addition, a spring structure acts on the turnable component to urge the latter to carry out its closing movement with respect to the stationary component.

11 Claims, 8 Drawing Figures

FIG. 7
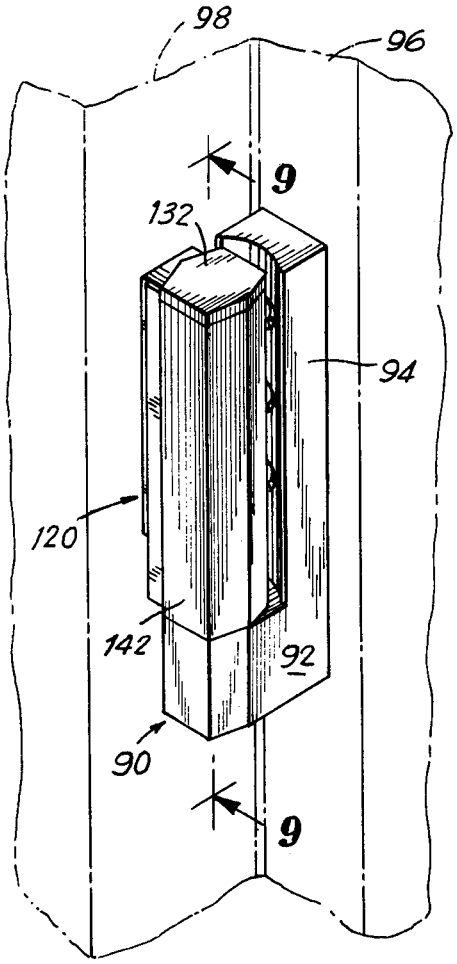
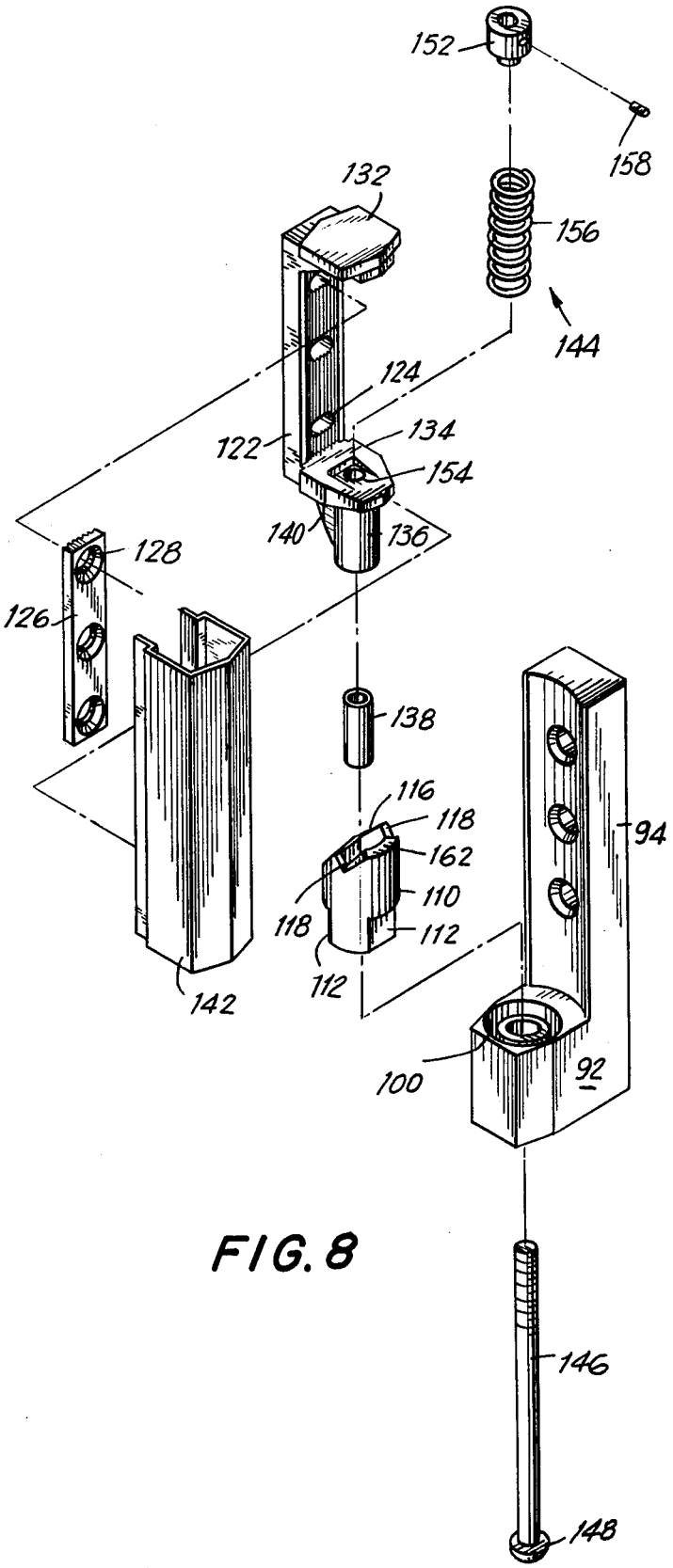
FIG. 8

SELF-CLOSING SPRING HINGES

BACKGROUND OF THE INVENTION

The present invention relates to hinges.

It is already known to provide hinges with construction according to which a turnable hinge component with the structure to which it is connected moves upwardly with respect to a stationary hinge component during opening movement and downwardly with respect to the stationary component during closing movement. This operation is achieved by way of a suitable cam structure, with the arrangement being such that the weight of the door or the like carried by the turnable hinge component acts to urge the door and turnable hinge component carrying the same to carry out the closing movement.

While certain advantages are achieved by way of a construction of the above type, such as utilizing the weight of the door itself to urge the door toward its closed position, experience has shown that the desired results are not always reliably achieved with such a construction. Thus, when structures of the above type conventionally include suitable cams, these cams do not always operate reliably. Although they are intended to have cooperating camming surfaces of relatively low friction, these surfaces do not always move freely one with respect to the other and the part which is intended to close under the force of its own weight sometime does not close fully, so that manual operations are required for manually swinging the door all the way up to its fully closed position.

In addition, when a door provided with a hinge structure of the above type is fully open, it will not reliably remain open because vibrations or the like can easily dislodge the turnable cam with respect to the stationary cam so that undesirable closing movement will result under certain conditions.

SUMMARY OF THE INVENTION

It is accordingly a primary object of the present invention to provide a hinge construction which will avoid the above drawbacks.

In particular it is an object of the present invention to provide a hinge construction which will operate in such a way that once the closing movement of a door or the like is started, this closing movement will reliably continue all the way up to the complete closing of the door without requiring any further manual operation or attention on the part of the operator.

Also, it is an object of the present invention to provide a construction of the above type which when a door or the like is fully opened will be capable of operating reliably to maintain the door in its fully opened position until the operator initiates the closing movement.

It is furthermore an object of the present invention to provide a construction of the above type which is simple an inexpensive while at the same time being rugged and reliable in operation.

Furthermore, it is an object of the present invention to provide a construction of the above type which can readily be used either for right or left-hand doors or the like.

In addition, it is an object of the present invention to provide a construction according to which it is possible to adjust the force which urges the door or the like toward its closed position.

According to the invention the hinge has a support means and a stationary cam means fixed to and carried by this support means. A movable means is adapted to be connected by a suitable connecting means to a turnable part such as a door which is to turn with respect to the stationary part. A turnable cam means is fixed to and carried by this movable means. The stationary cam means cooperates with the turnable cam means to guide the latter for turning movement with respect to the stationary cam means about a predetermined hinge axis, and the stationary and turnable cam means respectively have mating camming surfaces which are inclined with respect to this hinge axis. A mounting means is fixed to the support means for mounting the latter on a stationary part with the camming surface of the stationary cam means situated beneath the camming surface of the turnable cam means and with the hinge axis being substantially upright. Thus, the camming surface of the turnable cam means rises upwardly and downwardly along the camming surface of the stationary cam means during opening and closing turning movement, respectively, of the movable means. According to the invention a spring means engages the movable means and urges the latter along the hinge axis toward the stationary cam means so that opening movement of the movable means is carried out in opposition to the spring means while the weight of the turnable part and the spring means both act to urge the movable means to carry out a closing movement with respect to the support means and the stationary cam means fixedly carried thereby.

BRIEF DESCRIPTION OF DRAWINGS

The invention is illustrated by way of example in the accompanying drawings which form part of this application and in which:

FIG. 7 is a perspective illustration of another embodiment of the invention;

FIG. 8 is an exploded perspective view of the hinge structure of FIG. 7;

FIG. 11 is a partly sectional plan view taken along line 11—11 of FIG. 10 in the direction of the arrows showing in solid and phantom lines right-and-left hand mountings for a swingable door or the like.

DESCRIPTION OF PREFERRED EMBODIMENTS

Figures 1, 2:
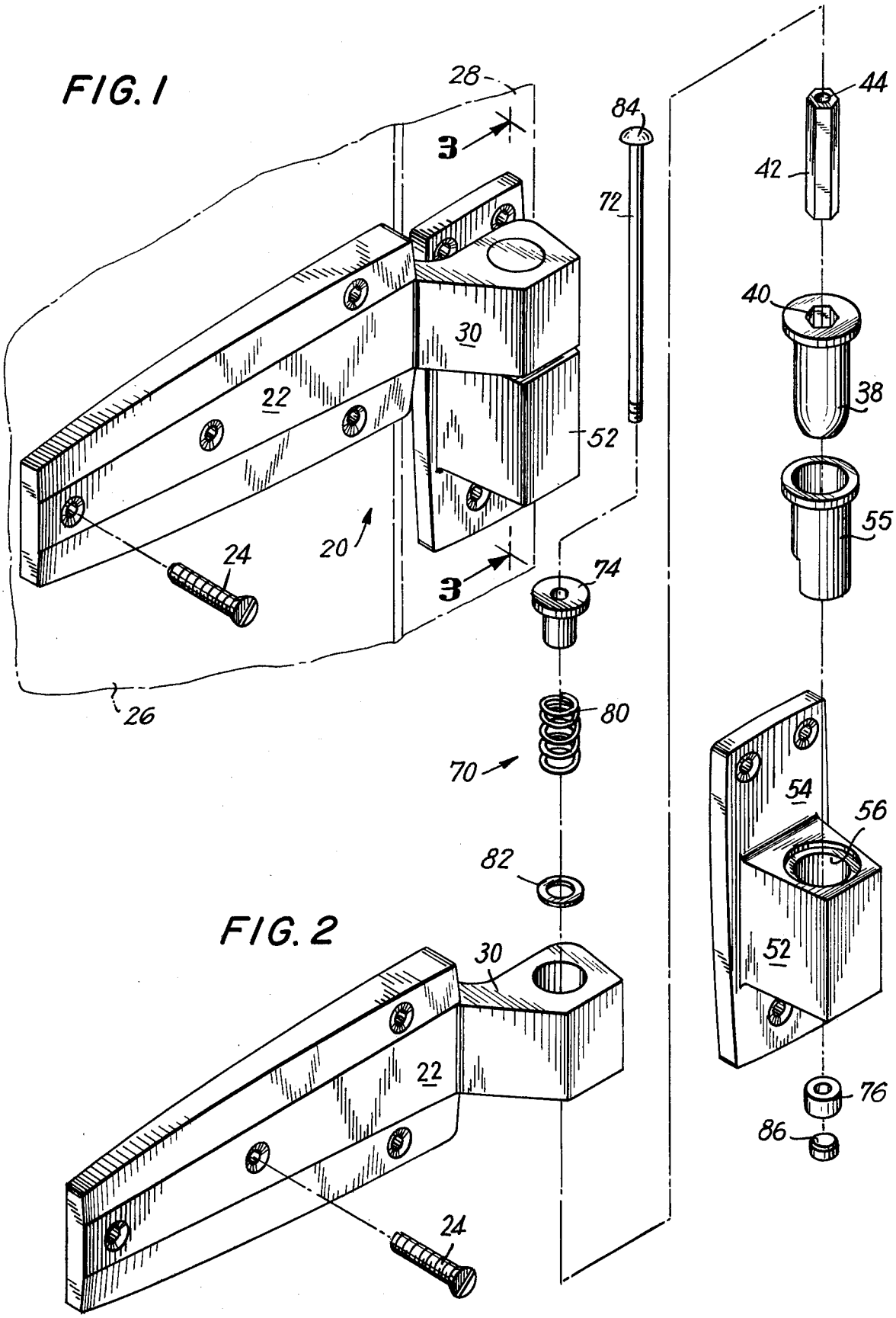
FIG. 1 is a perspective illustration of a hinge of the invention.
FIG. 2 is an exploded perspective illustration of the hinge of FIG. 1.
Figure 3:
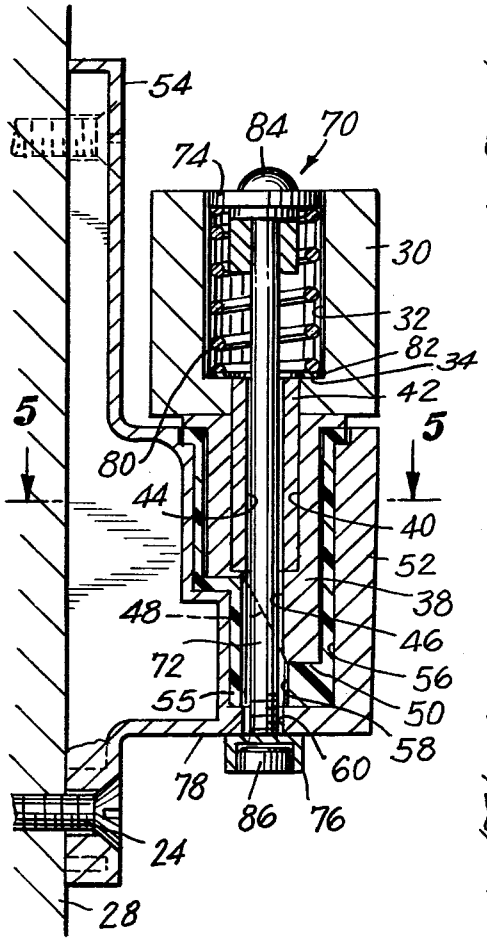
FIG. 3 is a sectional elevation of the hinge of FIG. 1 taken along line 3—3 of FIG. 1 in the direction of the arrows, the hinge being shown in FIGS. 1 and 3 in a position where a door, for example, is closed.
Figure 9:
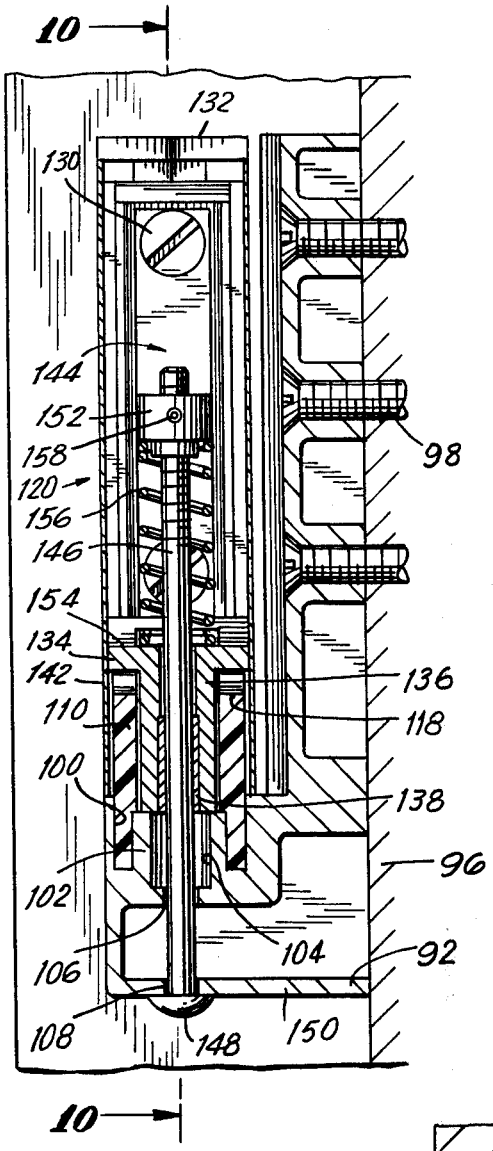
FIG. 9 is a sectional elevation taken along line 9—9 of FIG. 7 in the direction of the arrows.
Figure 10:
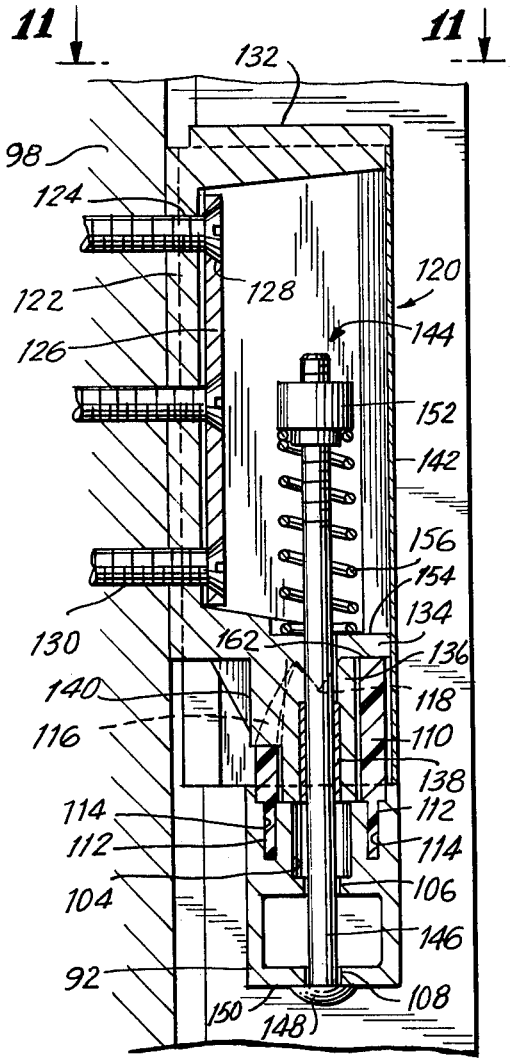
FIG. 10 is a sectional elevation taken along line 10—10 of FIG. 9 in the direction of the arrows.
Figure 11:
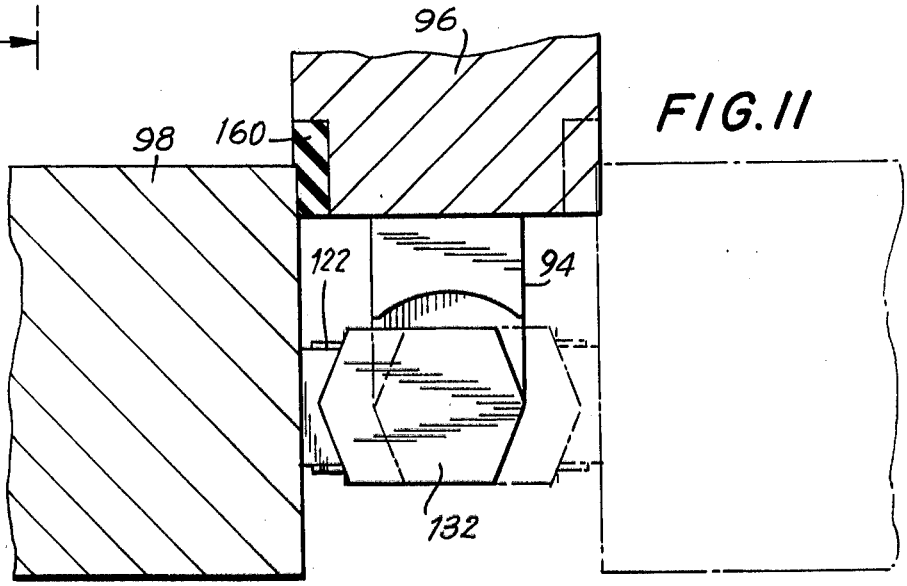

Referring to FIG. 1, the hinge 20 of the present invention illustrated therein includes a movable means 22 having an elongated horizontally extending arm formed with countersunk bores for receiving screws 24 by means of which the movable means 22 can be fixed with a door 26 or the like shown in phantom lines in FIG. 1. Beside the door 26 there is fragmentarily illustrated in phantom lines a stationary part 28 with respect to which the door 26 is hung for swinging movement by way of the hinge 20. For example the part 28 may be a frame of a refrigerator while the door 26 may be a door of the refrigerator. It will be noted that the hinge 20 of FIG. 1 provides a flush-type of mounting of the door 26 with respect to the frame 28 and includes a number of offsets. The movable means 22 has at its right end, as viewed in FIG. 1, a portion 30 which may be integral with the arm fixed to the door 26 and which is situated in front of and spaced from the stationary part 28. As is best shown in FIG. 3, the portion 30 is formed with a stepped bore 32 having an open top and providing the movable means 22 at its portion 30 with a shoulder or upwardly directed surface 34.

Figure 6:
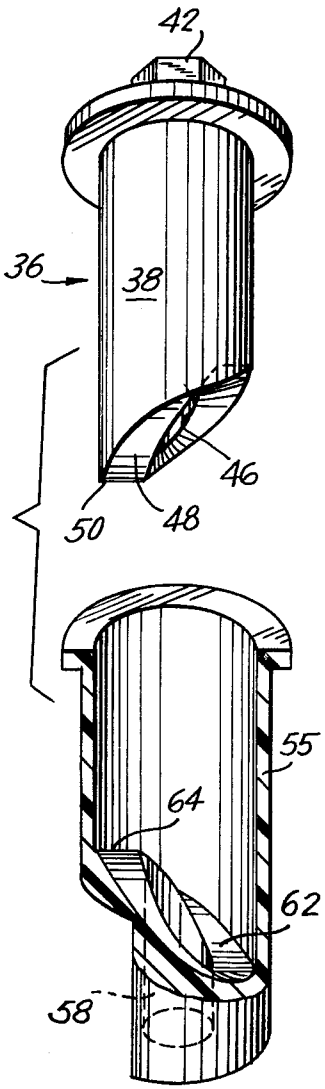
FIG. 6 is a partly sectional perspective illustration of a turnable cam means and a stationary cam means forming part of the structure of FIGS. 1–5.
Figure 5:
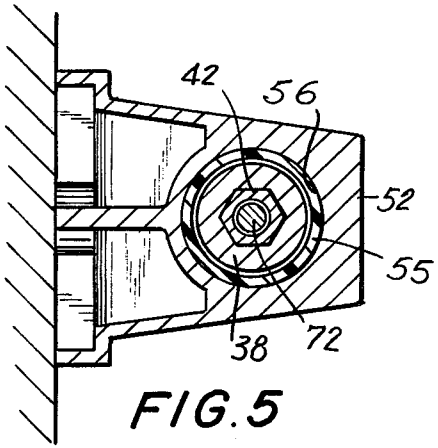
FIG. 5 is a transverse sectional plan view of the structure of FIG. 3 taken along line 5—5 of FIG. 3 in the direction of the arrows.

The movable means 22 is fixedly connected with a turnable cam means 36 shown at the upper part of FIG. 6 and including a metal cam member 38 which has a smooth exterior surface of low friction. For example the metal cam member 38 of the turnable cam means 36 may be chrome-plated. The metal cam member 38 is formed with a non-circular bore 40 which may be hexagonal in cross section, for example, and which receives in its interior an elongated axially bored member 42 which is also of hexagonal cross section, this member 42 being fixed to the member 38 of the turnable cam means 36 in any suitable way as by being welded thereto, for example. The part of the portion 30 of the movable means 22 which is situated beneath the shoulder 34 is formed with a bore of hexagonal cross section receiving the upper portion of the elongated member 42 which is fixed to the portion 30 in any suitable way as by being welded thereto, for example, so that in this way the turnable cam means 36 is fixed with the movable means 22. It will be noted that the axial bore 44 which extends through the elongated member 42 forms a continuation of a bore 46 which extends through the cam member 38, this bore 46 having a shoulder against which the bottom end of the elongated member 42 is situated. As will be apparent from the description below, the common axis of the bores 44 and 46, as well as the bore 32 coincides with the hinge axis, and at its bottom surface the cam means 36 is provided with a camming surface 48 which is inclined with respect to this hinge axis, the camming surface 48 having a bottom or lower flat end region 50 from which the camming surface 48 extends upwardly substantially symmetrically in the manner of parts of a pair of oppositely directed helical portions.

The structure thus far described above is carried by a support means 52 which is fixed with a mounting means 54 by means of which the support means 52 is mounted, by suitable screws extending through countersunk bores, on the stationary part 28. As is apparent from FIGS. 3 and 4, the mounting means 54 is preferably hollow so that the weight of the hinge 20 can be less than if the mounting means 54 were solid. The same is true of the arm of the movable means 22 which is fixed to the movable part 26. All of the parts thus far described above may be made of a suitable relatively rigid metal.

Thus, by being mounted on the stationary part 28, the support means 52 remains stationary during use of the hinge 20, and this support means 52 fixedly carries a stationary cam means 55 which is preferably made of a plastic such as a hard nylon. Thus it will be seen that the support means 52 is formed with a bore 56 which has an open top and which has an inner surface matching the exterior partially stepped configuration of the stationary cam means 55, so that this cam means is received in the manner illustrated in the bore 56 while being incapable of moving with respect to the support means 52.

The stationary cam means 55 itself is hollow and has an open top, and the turnable cam means 36 is received in the hollow interior of the stationary cam means 55. The exterior cylindrical surface of the turnable cam means 38 slidably engages the interior cylindrical surface of the stationary cam means 55 so that the cam means 55 guides the turnable cam means 38 for turning movement about the hinge axis which coincides with the axis of the several coaxial bores 32, 44, and 46. In addition it will be noted that this bore 46 forms a continuation of a bore 58 extending through the lower portion of the stationary cam means 55 and being coaxial with the bore 46. Also, it will be seen that the lower wall portion of the stationary support means 52 is formed with a bore 60 which is coaxial with and forms a continuation of the bore 58, so that all of these coaxial bores cooperate to form a continuous through-bore extending through the entire assembly as is clearly apparent from FIGS. 3 and 4.

At its inner lower region the stationary cam means 55 is formed with an upwardly directed camming surface 62 which mates with and is situated directly beneath the camming surface 48 of the turnable cam means 38 when the hinge is in the closed position shown in FIG. 3. This camming surface 62 of the stationary cam means 55 has an upper end surface region 64 which is flat and which is engaged by the flat lower end surface region 50 of the camming surface 48 when the movable means 22 has been turned through 180° from the closed position of FIG. 3 in an opening direction to the open position of FIG. 4. However, this latter angle may range from 120° to 180°.

Figure 4:
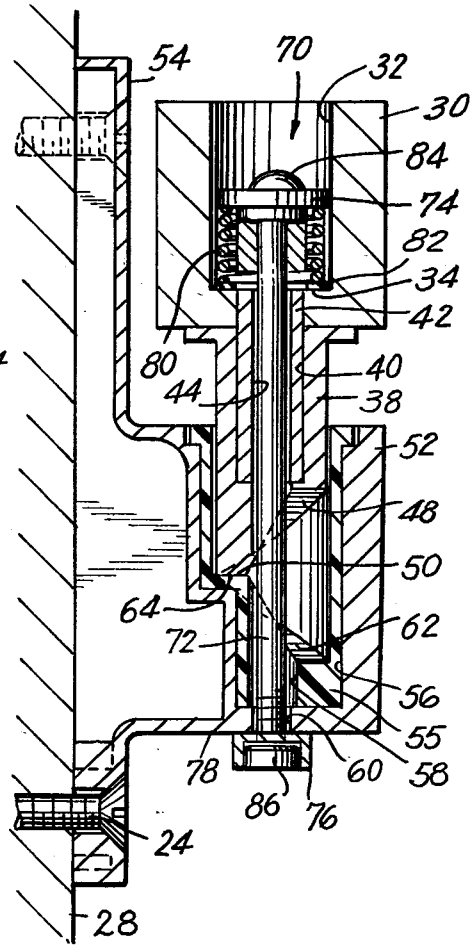
FIG. 4 shows the hinge structure of FIG. 3 in the position it takes when the door has been swung to an open position.

While the structure thus far described above is capable of functioning as a hinge, this functioning of the above-described structure alone is not satisfactory under all circumstances. Thus it will be seen that when the turnable part 26 is swung from a closed position where the hinge structure parts are positioned as illustrated in FIG. 3 to an open position where the parts have the position of FIG. 4, the part 26 together with the movable means 22 and the turnable cam means 36 move upwardly along the hinge axis while turning thereabout, with the flat surface 50 engaging the flat surface 64 in the fully open position as shown in FIG. 4. When it is desired to close the door 26 or the like, once the surface 50 turns beyond the surface 64, the weight of the part 26 urges the hinge to continue to turn to its closed position. However, experience has shown that sometimes the turnable cam means will stick with respect to the stationary cam means so that a full closing is not achieved and the operator must carefully move the door 26 or the like manually to the fully closed position. In addition, when the parts have the position of FIG. 4 the engagement between the flat end surface regions 50 and 64 is not fully stable and vibrations or the like, for example in the vicinity of the hinge can cause a closing movement to start in an undesirable manner.

In order to avoid these problems there is provided in accordance with the present invention a spring means 70 which engages the movable means 22 for urging the latter downwardly along the hinge axis so that by way of the spring means 70 a force in addition to the weight of the part 26 is available for urging the part 26 to its closed position, thus achieving a reliable closing movement without care being taken on the part of the operator, and furthermore when the parts are in the open position of FIG. 4 the spring means 70 acts to press the end surface region 50 of the turnable cam means 38 against the end surface region 64 of the stationary cam means 55, so that in this way the hinge will be reliably maintained in its open position. The spring means 70 includes an elongated rod 72 extending freely through the common through-bore formed by the successive coaxial bores 32, 44, 46, 58, and 60. The rod 72 has an upper enlarged portion 74 situated above the upwardly directed surface 34 of the movable means 22 with a portion of the rod 72 also extending above this upwardly directed surface 34. The rod 72 also has a lower enlarged portion 76 engaging a downwardly directed surface 78 of the support means 52. A springy structure 80 is compressed between the surface 34 and the enlarged portion 74 of the rod 72 so that the spring means acts in the manner set forth above to urge the movable means 22 downwardly along the hinge axis toward the stationary cam means 55. In the illustrated example the springy structure 80 takes the form of a coil spring surrounding that portion of the rod 72 which extends upwardly beyond the surface 34. This surface 34 is directly engaged by a washer 82 which in turn engages the lower convolution of the coil spring 80. The enlarged portion 74 is in the form of a sleeve through which the rod 72 extends and having at its top end a flange the lower surface of which engages the top convolution of the spring 80. Above the sleeve 74 the rod 72 has an enlarged head end 84. The enlarged portion 76 is in the form of a nut which is threaded onto a lower portion of the rod 72, so that through this nut not only are the parts of the spring means 70 maintained assembled with each other but also a certain amount of adjustment of the compression of the spring 80 can be provided. The nut 76 is formed with a downwardly directed enlarged recess frictionally receiving in its interior a plug 86.

Thus, when the part 26 is turned together with the movable means 22 in an opening direction of movement, the upward travel of the movable means 22 and the door or the like 26 is carried out in opposition to the spring means 70, the springy structure 80 of which becomes further compressed as is apparent from a comparison of FIGS. 3 and 4. In this way there is stored in the spring 80 a force which will on the one hand reliably maintain the parts in the position of FIG. 4 and which will on the other hand contributed to reliable closing movement as set forth above. The construction described above is particularly suitable for refrigerators, freezers and the like, since the added force achieved from the spring 80 will in addition to the force provided by way of the weight of the door 26 assure that the door is fully closed.

The embodiment of the invention which is illustrated in FIGS. 7–10 will achieve the same advantages as that of FIGS. 1–6. The embodiment of FIGS. 7–10 is provided for an edge-mounted door and in addition the embodiment of FIGS. 7–10 may be utilized without changes for both left-and-right-hand mountings.

Referring to FIG. 7, it will be seen that the hinge 90 of the invention illustrated therein includes a stationary support means 92 carrying a mounting means 94 by means of which the support means 92 is fixedly mounted on a stationary part 96 shown in phantom lines in FIG. 7. This stationary part 96 may form part of frame with respect to which a door 98, also shown in phantom lines, is to swing. The mounting means 94 is formed with countersunk bores through which fastening screws 98 extend (FIG. 9) for fixedly mounting the support means 92 on the stationary part 96. The support means 92 is formed with an upwardly directed hollow recess or bore 100 which has in its interior an upwardly extending hollow sleeve portion 102 which is integral with and forms part of the support means 92. The sleeve 102 has a bore 104 which is coaxial with smaller bores 106 and 108 which thus form continuations of the bore 104 with the bore 108 being formed in the lower wall portion of the support means 92, as is most clearly apparent from FIG. 9.

The support means 92 fixedly carries a stationary cam means 110 which in this case also is preferably made of a hard plastic material such as nylon, which has a low coefficient of friction. The stationary cam means 110 has a tubular construction and is received at its lower portion in the bore 100 which surrounds the inner sleeve portion 102 of the support means 92. At its lower portion which is received in the bore 100 the stationary cam means 110 is provided with a pair of opposed flats 112 mating with corresponding flat surfaces 114 in the bore 100. (FIG. 10), so that in this way the stationary cam means 110 is prevented from turning. The stationary cam means 110 has an upper camming surface 116 which slopes downwardly from a pair of opposed uppermost substantially V-shaped recesses 118, the camming surface 116 thus being of a substantially V-shaped configuration and being directed toward the movable part 98 which may take the form of a door such as a refrigerator door. The opposed recesses 108 form in this embodiment the upper end regions of the camming surface of the stationary cam means 110, these upper end regions being adapted to cooperate with a turnable cam means when the door 98 is in its fully open position, as will be apparent from the description below.

The embodiment of the invention which is illustrated in FIGS. 7–11 includes a movable means 120 to which the movable part 98 is fixed for turning movement with the movable means 120. This movable means 120 includes a wall 122 adapted directly to engage the movable part 98 at an edge thereof, the wall 122 being formed with a plurality of horizontally extending slots 124. Also, the surface of wall 122 which is directed away from the part 98 is formed with longitudinally extending serrations. These serrations engage serrations formed on a surface of an elongated plate 126 formed with countersunk bores 128 which become aligned with the slots 124 so that suitable fastening screws 130 can extend through these components, as shown most clearly in FIG. 10, for the purpose of fixing the movable part 98 to the movable means 120. The wall 122 has an upper arm 132 which forms the top end of the movable means 120 and a lower arm 134. The lower arm 134 is integrally formed with a downwrdly extending tubular projection 136 which in its interior fixedly carries a bearing sleeve 138 and which at its exterior is received in the interior of the stationary cam means 110. Thus, the part 136 forms a portion of a turnable cam means which is guided by way of the stationary cam means 110 for turning movement about the hinge axis. The tubular portion 136 of the turnable cam means has an integral camming portion 140 which mates with the camming surface 116 and which thus is also of a substantially V-shaped configuration. Thus in the closed position shown in FIG. 10 it will be seen that the cam 140 has its downwardly directed camming surfaces engaging and mating with the upwardly directed camming surfaces 116.

A springy elongated extrusion 142 made of any suitable metal or plastic is capable of being snapped onto the flower portion of the upper arm 132 while extending around the lower arm 134 so as to define with the wall 122 a space in which the plate 126 and the heads of the screws 130 are located.

The structure as thus far described for the embodiment of FIGS. 7–11 is capable of functioning as a hinge although in this case also there will be certain drawbacks because such a construction does not include the spring means of the invention. Thus it is apparent that the part 98 can be turned together with the movable means 122 around the hinge axis causing the downwardly directed camming surface of the cam portion 140 to ride upwardly along one or the other of the sides of the camming surface 116 until the lower pointed end region of the cam portion 140 is received in one of the recesses 118, this particular recess being the left recess 118 as viewed in FIG. 8, with the particular mounting shown in FIG. 7 and in solid lines in FIG. 11. In this case because of the edge mounting provided by the hinge of this embodiment a 90° opening movement is sufficient. If only recess 118 is provided and suitably positioned, this latter angle may be, for example, 120°. However, as was pointed out above, because of a lack of stability in the open position and because the weight of the part 98 cannot be relied upon to fully close the part 98, a spring means is provided in accordance with the present invention.

The spring means 144 of the embodiment of FIGS. 7–11 also includes an elongated rod 146 which extends through the coaxial bores 108, 106, 104, and the bore of the sleeve 136 which receives the tubular component 138 as described above. This rod 146 has a lower enlarged portion 148 engaging a downwardly directed surface 150 of the support means 92. Also the rod 146 has an upper enlarged portion 152 situated above the upwardly directed surface 154 of the movable means 122, this upwardly directed surface 154 being situated at the top end of the bore which extends through the sleeve portion 136 of the turnable cam means of this embodiment. In this case also the spring means 144 includes a springy structure 156 in the form of a coil spring surrounding the portion of the rod 146 which extends above the surface 154. This spring 156 is compressed between the upwardly directed surface 154 and the enlarged portion 152 of the rod 146. In this embodiment the enlarged portion 152 is in the form of a nut which is threaded onto an upper threaded portion of the rod 146 and which is formed with a radial threaded bore receiving a set screw 158. Thus the nut 152 can be turned with respect to the rod 146 so as to adjust the compression of the spring 156, and then the set screw 158 can be turned to hold the nut 152 in its adjusted position.

Thus, it will be seen that with this construction when the movable means 122 is turned with the part 98 in the opening movement direction, the downwardly directed camming surface of portion 140 of the turnable cam means will ride upwardly along the upwardly directed camming surface 116 of the stationary cam means 110 until the parts reach the fully open position where the pointed end region of cam 140 is received in one of the recesses 118. This opening movement is of course carried out in opposition to the spring 156 which thus becomes further compressed while the part 98 together with the movable means 122 rise upwardly along the hinge axis. Thus the spring 156 when thus compressed at the end of the opening movement will reliably maintain the pointed lower end region of the camming portion 140 in one of the recesses 118. To bring about closing movement, it is only necessary for the operator to displace the pointed lower end region of the camming portion 140 out of the recess 118, and now in addition to the weight of the part 98 there is available the force of the spring 156 to reliably urge the hinge to the fully closed position.

It will be noted that when the hinge 120 of FIGS. 7–11 is in the closed position the pair of cam means which include the turnable cam means 136, 140 and the stationary cam means 110 are symmetrical with respect to a plane of symmetry which contains the hinge axis and which is parallel to the flat surface of the mounting means 94 which directly engages the stationary part 96. As a result of this arrangement it is only necessary to reverse the position of the stationary cam means 110 in order to adapt the structure of this embodiment either for left-hand or right-hand mounting. Thus it will be seen that the solid line illustration of FIG. 11 corresponds to the illustration of FIGS. 7–10. It will be noted that in this position the turnable part 98 engages a sealing member 160 carried by the stationary part 96. This solid line position shown in FIG. 8 corresponds to a right-hand mounting. In order to provide a left-hand mounting, the very same structure of the hinge can be used. It is only required to remove the cam 110 and turn it through 180° about the hinge axis and then to replace the cam 110 in the support means 92. Now a door or the like can be mounted with the hinge structure having the position shown in phantom lines in FIG. 11. The only difference is that at this time the recess 118 shown at the right in FIG. 8 is the one which is situated most distant from the part 96 and which cooperates with the lower pointed end region of the camming portion 140 when the door is swung to the fully open position.

Of course, while only one hinge of each embodiment has been described above, it will be understood that, for example, a pair of such hinges will be provided at upper and lower portions of a door or the like. It is to be noted that in the embodiment of FIGS. 7–11 the turnable cam means 136, 140 is also made of metal having a smooth exterior surface, such as a surface provided by chrome-plating, for example, so that there is a very low coefficient of friction between the turnable cam means and the stationary cam means 110 which preferably is made of a hard nylon, as pointed out above.

As is apparent from the above description, the hinges of the invention are of a simple robust construction while at the same time operating very reliably. In the case of FIGS. 7–11 it will be noted that the springy cover 142 defines with the wall 122 and with the arms 132 and 134 a space for accommodating not only the plate 126 but also the upper portion of the spring means 144 and part of the cam structure.

In addition to the advantages set forth above in connection with the structure of the invention, there are a number of further advantages. Thus, the door or the like will reliably remain in its open position as set forth above, and in addition the open position can include a relatively large angle. Thus in the case of FIGS. 1–6, this angle is determined by the area of the flat end regions 50 and 64 of the turnable end stationary cam means. In the case of FIGS. 7–11, while there is a hold-open position when the door has been turned so that the pointed lower end portion of the turnable cam means is received in one or the other of the recesses 118, it is possible to turn the door to a further open position with the lower pointed portion of the cam 140 riding at this time on the flat surface portion 162 of the stationary cam means 110, this flat surface portion 162 being situated at the side of the recesses 118 opposite from the inclined camming surface 116. The pressure of the spring 156 will reliably maintain the door of the embodiment of FIGS. 7–11 in any position pressing the lower portion of the cam 140 against the surface 162, so that a large dwell surface in the open position is provided particularly with this embodiment. In addition, the cooperation of a metal cam with a plastic cam described above enables these cams to cooperate and slide freely one with respect to the other without requiring any lubrication.

Furthermore, the spring means of the invention serves not only to contribute to reliable closing of the door but in addition the spring means holds the door closed with a given closing pressure which is a further important advantage in particular with refrigerators, freezers, and the like. It is to be noted that the force of the spring means of the invention is sufficient to overcome any friction of door seals and any friction of a floor wiper so that the door is tightly closed and held with a substantial pressure against the door seals. Thus with the hinge of the invention it is possible to eliminate the door snugger which is used on hinges which do not have the spring-hold advantage of the present invention. The structure of the invention is particularly effective in a multi-door refrigerated box.

Because the cam surfaces act to raise the door during opening movement thereof, dirt will not be swept into the refrigerator or the like and dirt will not get into the hinged door enclosures. It will be noted that if the door is opened slightly with the structure of the invention, upon release of the door it will be reliably closed and held tightly against the door seals.

What is claimed is:

1. A hinge comprising support means, stationary cam means fixed to and carried by said support means, movable means, turnable cam means fixed to and carried by said movable means, said stationary cam means cooperating with said turnable cam means to guide the latter for turning movement with respect to said stationary cam means about a predetermined hinge axis, said stationary and turnable cam means respectively having mating camming surfaces which are inclined with respect to said axis, mounting means fixed to said support means for mounting the latter on a stationary part with said camming surface of said stationary cam means situated beneath said camming surface of said turnable cam means and with said axis having a substantially upright attitude, said movable means carrying a connecting means for connecting to said movable means a turnable part which is to turn with respect to said stationary part, and said camming surface of said turnable cam means riding upwardly and downwardly along said camming surface of said stationary cam means during opening and closing turning movement, respectively, of said movable means, and spring means engaging said movable means and urging the latter along said axis toward said stationary cam means so that opening movement of said movable means is carried out in opposition to said spring means while the weight of the turnable part and said spring means both act to urge said movable means to carry out a closing movement with respect to said support means and stationary cam means.

2. The combination of claim 1 and wherein said supprt means, stationary cam means, turnable cam means, and movable means are all formed with a continuous through-bore having an axis coinciding with said hinge axis, said support means and movable means respectively having at opposed ends of said through-bore, surfaces directed downwardly and upwardly when said support means is mounted on said stationary part, said spring means including an elongated rod extending through and beyond said through-bore, having a lower enlarged portion engaging said downwardly directed surface of said support means, and having an upper enlarged portion situated higher than said upwardly directed surface of said movable means, and said spring means including a springy structure compressed between said upper enlarged portion of said rod and said upwardly directed surface of said movable means for urging the latter together with said turnable cam means toward said stationary cam means and said support means.

3. The combination of claim 2 and wherein said springy structure is in the form of a coil spring surrounding the portion of said rod which extends beyond said upwardly directed surface of said movable means up to said upper enlarged portion of said rod.

4. The combination of claim 2 and wherein said lower enlarged portion of said rod is in the form of a nut threaded onto said rod.

5. The combination of claim 2 and wherein said upper enlarged portion of said rod is in the form of a nut threaded onto said rod.

6. The combination of claim 2 and wherein said support means is formed with a bore having an open top and in which said stationary cam means is fixed with said stationary cam means being hollow and having an open top and receiving said turnable cam means, said movable means having over said turnable cam means a portion formed with a bore receiving said spring means and said upper enlarged portion of said rod as well as the part of said rod which extends upwardly beyond the upwardly directed surface of said movable means, the latter upwardly directed surface forming a shoulder of said bore of said movable means which receives said spring means.

7. The combination of claim 1 and wherein one of said cam means is made of plastic and the other of said cam means is made of metal.

8. The combination of claim 1 and wherein said stationary and turnable cam means respectively have upper and lower end surface regions engaging each other at the end of opening movement of said movable means, and said spring means pressing said end surface regions against each other at the end of said opening movement for releasably holding the movable means in an open position.

9. The combination of claim 8 and wherein said end surface regions are flat.

10. The combination of claim 8 and wherein one of said end surface regions is substantially pointed and the other is in the form of a recess receiving said pointed end surface region.

11. The combination of claim 1 and wherein said support means has a flat end surface for engaging said part to which said support means is fixed by said mounting means, said flat end surface of said support means being situated in a predetermined plane parallel to but spaced from said axis, and said pair of cam means both having a common plane of symmetry parallel to said predetermined plane and containing said axis, said stationary cam means being carried by said support means in one of a pair of positions angularly displaced about said hinge axis by 180°, so that said movable means may be used either for left-hand or right-hand turning.

* * * * *